US009165427B2

(12) United States Patent
Thomas et al.

(10) Patent No.: US 9,165,427 B2
(45) Date of Patent: Oct. 20, 2015

(54) WAGERING GAME WITH MULTIPLE BONUS TRIGGERING FEATURE AND BONUS ACCRUAL FEATURE

(75) Inventors: Alfred Thomas, Las Vegas, NV (US); Benjamin T. Gomez, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 1816 days.

(21) Appl. No.: 11/991,519

(22) PCT Filed: Sep. 7, 2006

(86) PCT No.: PCT/US2006/034947

§ 371 (c)(1), (2), (4) Date: Mar. 5, 2008

(87) PCT Pub. No.: WO2007/030670

PCT Pub. Date: Mar. 15, 2007

(65) Prior Publication Data

US 2009/0069063 A1 Mar. 12, 2009

Related U.S. Application Data

(60) Provisional application No. 60/715,225, filed on Sep. 8, 2005.

(51) Int. Cl.
*G07F 17/32* (2006.01)

(52) U.S. Cl.
CPC ..... *G07F 17/3244* (2013.01); *G07F 17/3262* (2013.01); *G07F 17/3267* (2013.01)

(58) Field of Classification Search
CPC ... G07F 17/32; G07F 17/3244; G07F 17/326; G07F 17/3262; G07F 17/3267
USPC ..... 463/16–28
See application file for complete search history.

(56) References Cited

U.S. PATENT DOCUMENTS

| | | | | |
|---|---|---|---|---|
| 5,947,820 | A * | 9/1999 | Morro et al. | 463/9 |
| 6,311,976 | B1 | 11/2001 | Yoseloff et al. | |
| 6,656,040 | B1 | 12/2003 | Brosnan et al. | |
| 6,733,389 | B2 * | 5/2004 | Webb et al. | 463/20 |
| 6,786,824 | B2 * | 9/2004 | Cannon | 463/42 |
| 6,860,810 | B2 | 3/2005 | Cannon et al. | |
| 6,997,805 | B2 * | 2/2006 | Vancura | 463/20 |
| 7,070,501 | B2 | 7/2006 | Cormack et al. | |
| 7,166,028 | B2 * | 1/2007 | Fasbender et al. | 463/20 |
| 7,311,598 | B2 * | 12/2007 | Kaminkow et al. | 463/16 |
| 7,419,162 | B2 * | 9/2008 | Lancaster et al. | 273/292 |
| 7,500,913 | B2 * | 3/2009 | Baerlocher | 463/16 |
| 7,614,953 | B2 | 11/2009 | Souza et al. | |
| 7,618,316 | B2 * | 11/2009 | Cole et al. | 463/21 |
| 7,666,081 | B2 * | 2/2010 | Baerlocher et al. | 463/16 |
| 7,758,416 | B2 * | 7/2010 | Randall | 463/20 |
| 2003/0157978 | A1 * | 8/2003 | Englman | 463/16 |

(Continued)

OTHER PUBLICATIONS

International Search Report, (2 pages) dated Mar. 16, 2007.

*Primary Examiner* — Damon Pierce
(74) *Attorney, Agent, or Firm* — Nixon Peabody LLP

(57) ABSTRACT

In one aspect, there is provided a method of conducting a wagering game which includes the steps of conducting a plurality of basic wagering games and enabling a bonus game in response to a bonus triggering outcome achieved in any of the basic wagering games. The method also includes deferring the enabled bonus game to permit play after completion of play of the plurality of basic wagering games.

23 Claims, 11 Drawing Sheets

(56) References Cited

U.S. PATENT DOCUMENTS

2004/0162132 A1* 8/2004 Jaffe et al. ..... 463/20
2004/0266516 A1 12/2004 Thomas
2004/0266517 A1 12/2004 Bleich et al.
2005/0020340 A1* 1/2005 Cannon ..... 463/16
2006/0142077 A1* 6/2006 Miles et al. ..... 463/20
2006/0247041 A1* 11/2006 Walker et al. ..... 463/29

* cited by examiner

WAGERING GAME WITH MULTIPLE BONUS TRIGGERING FEATURE AND BONUS ACCRUAL FEATURE

CROSS-REFERENCE TO RELATED APPLICATIONS

This application is a U.S. national phase of, and claims priority to, International Application No. PCT/US2006/034947, filed Sep. 7, 2006, which claims the benefit of priority of U.S. Provisional Patent Application No. 60/715,225, filed Sep. 8, 2005, both of which are incorporated herein by reference in their respective entireties.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to novel features and steps relating to the triggering, timing, and conduct of bonus games.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

There exists a need for additional variety in the triggering, timing, and conduct of bonus games.

SUMMARY OF THE INVENTION

In accord with at least some aspects of the above method, the method may further include the act of retrieving stored information relating to the enabled bonus game from the data storage medium to permit play of the enabled bonus game. The method may further include the act of playing the enabled bonus game at a later time at a different gaming machine.

According to another aspect of the present invention, a method of conducting a wagering game includes the steps of conducting a block wagering game comprising a plurality of basic wagering games and enabling a bonus game in response to a bonus triggering outcome achieved in any of the basic wagering games during play of the block wagering game. The method also includes the step of deferring the enabled bonus game to permit play after completion of play of all basic wagering games in the block wagering game. Additional aspects thereof include the steps of deferring all enabled bonus games to permit play after completion of play of all basic wagering games and simultaneously playing a plurality of deferred enabled bonus games after completion of play of all basic wagering games.

According to another aspect of the invention, a method of conducting a wagering game includes the step of providing a plurality of game elements, each game element displaying at least one symbol representing at least one randomly determined outcome selected from a plurality of potential randomly determined outcomes. The method also includes providing, as at least one of the plurality of potential randomly determined outcomes, a multiple-bonus trigger outcome. The multiple-bonus trigger outcome enables triggering of a first bonus game in combination with at least a first predetermined combination of randomly determined outcomes in the remaining plurality of game elements, enables triggering of a second bonus game in combination with at least a second predetermined combination of randomly determined outcomes in the remaining plurality of game elements, and enables triggering of multiple bonus games in combination with at least a third predetermined combination of randomly determined outcomes in the remaining plurality of game elements.

According to yet another aspect of the invention, a method of conducting a wagering game includes the steps of obtaining eligibility for a plurality of bonus games having a first characteristic, deferring play of the plurality of bonus games having a first characteristic for which eligibility has been obtained, and trading in the deferred plurality of bonus games having a first characteristic for eligibility to play a bonus game having a second characteristic.

According to yet another aspect of the invention, a computer readable storage medium or media is encoded with instructions for directing a gaming device to perform the above methods and other embodiments and aspects of such methods expressly and implicitly disclosed herein.

In accord with at least some aspects of the concepts disclosed herein, a method of conducting a wagering game includes the acts of displaying a plurality of game elements bearing symbols representing randomly determined outcomes selected from a plurality of potential outcomes, simultaneously achieving a first bonus game triggering outcome and a second bonus game triggering outcome, and concurrently playing the first and second bonus games. An additional aspect of this method may include the act of displaying along the payline two symbols representing the second bonus game triggering outcome. The multiple-bonus trigger outcome may be related to each of the first bonus game triggering outcome and the second bonus game triggering outcome. In aspects of the above method, a first of the triggered multiple bonus games comprises an award picking bonus game. In aspects of the above method, a second of the triggered multiple bonus games comprises a multiplier picking bonus game. The award of the triggered multiple bonus games may comprise an amount obtained by multiplying at least one award picked in the award picking bonus game by at least one multiplier selected in the multiplier picking bonus game. The method may comprise, in some aspects, the act of retrieving stored information relating to the enabled multiple bonus games from a data storage medium to permit play of the enabled multiple bonus games. Additionally, the step of displaying may optionally comprise displaying a first game element bearing a first game symbol relating to the multiple-bonus trigger outcome, a second game element bearing a second game symbol representing a predetermined bonus game triggering outcome along a payline including the first game symbol, and a third game element bearing a third game symbol along a payline bearing the first game symbol and the second game symbol, the third game symbol also representing the predetermined bonus game triggering outcome. The step of displaying may further comprise displaying a fourth game element bearing a fourth game symbol representing another predetermined bonus game triggering outcome along a payline including the first game symbol, and a fifth game element bearing a fifth game symbol along a payline bearing the first game symbol and the fourth game symbol, the fourth game symbol also representing the another predetermined bonus game triggering outcome.

According to yet another aspect of the invention, a gaming device and/or system is configured to, in combination with a controller, perform the above methods and other embodiments and aspects of such methods expressly and implicitly disclosed herein.

Additional aspects of the invention will be apparent to those of ordinary skill in the art in view of the detailed description of various embodiments, which is made with reference to the drawings, a brief description of which is provided below.

DETAILED DESCRIPTION

Figure 1:
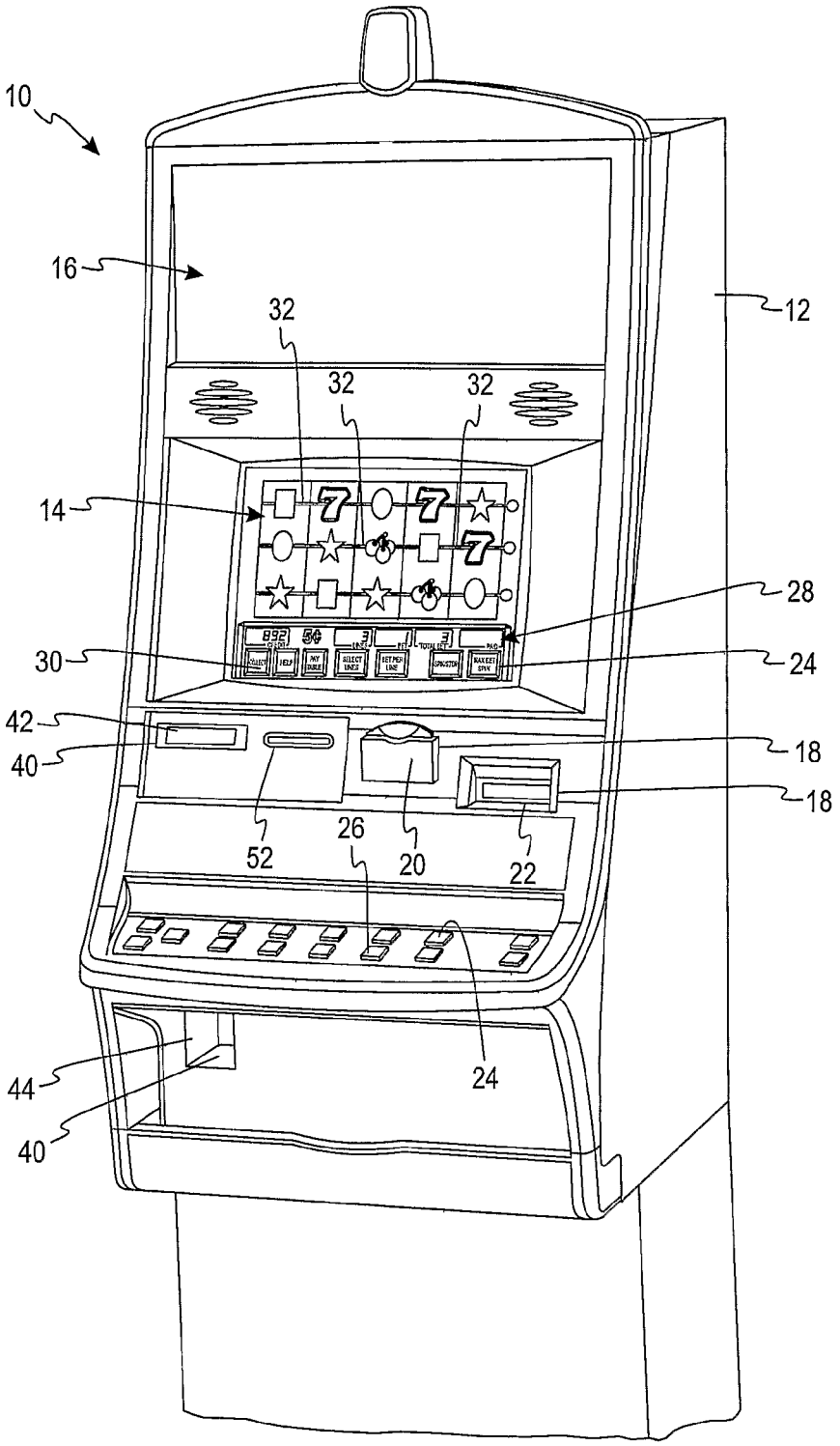
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
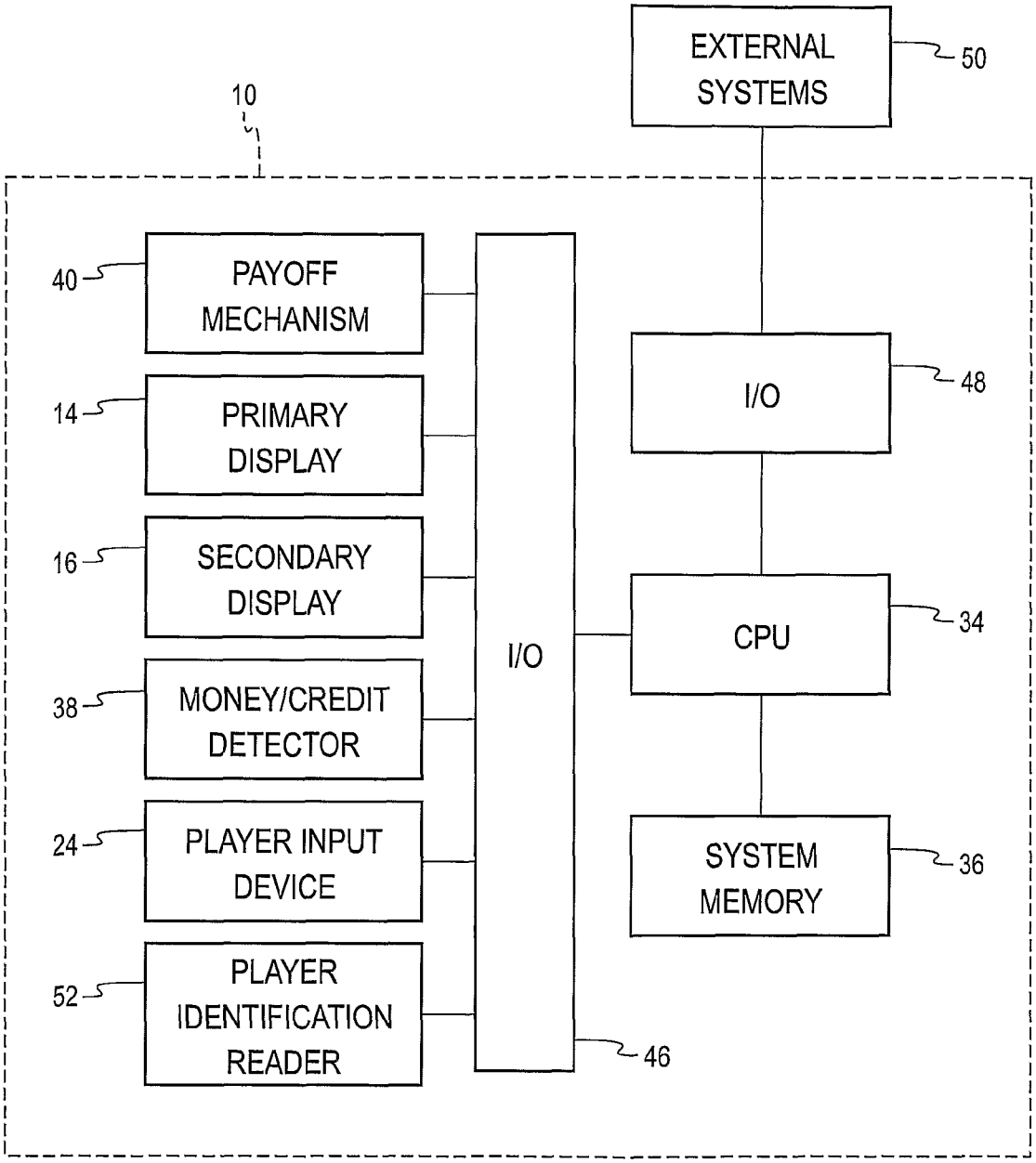
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10 bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
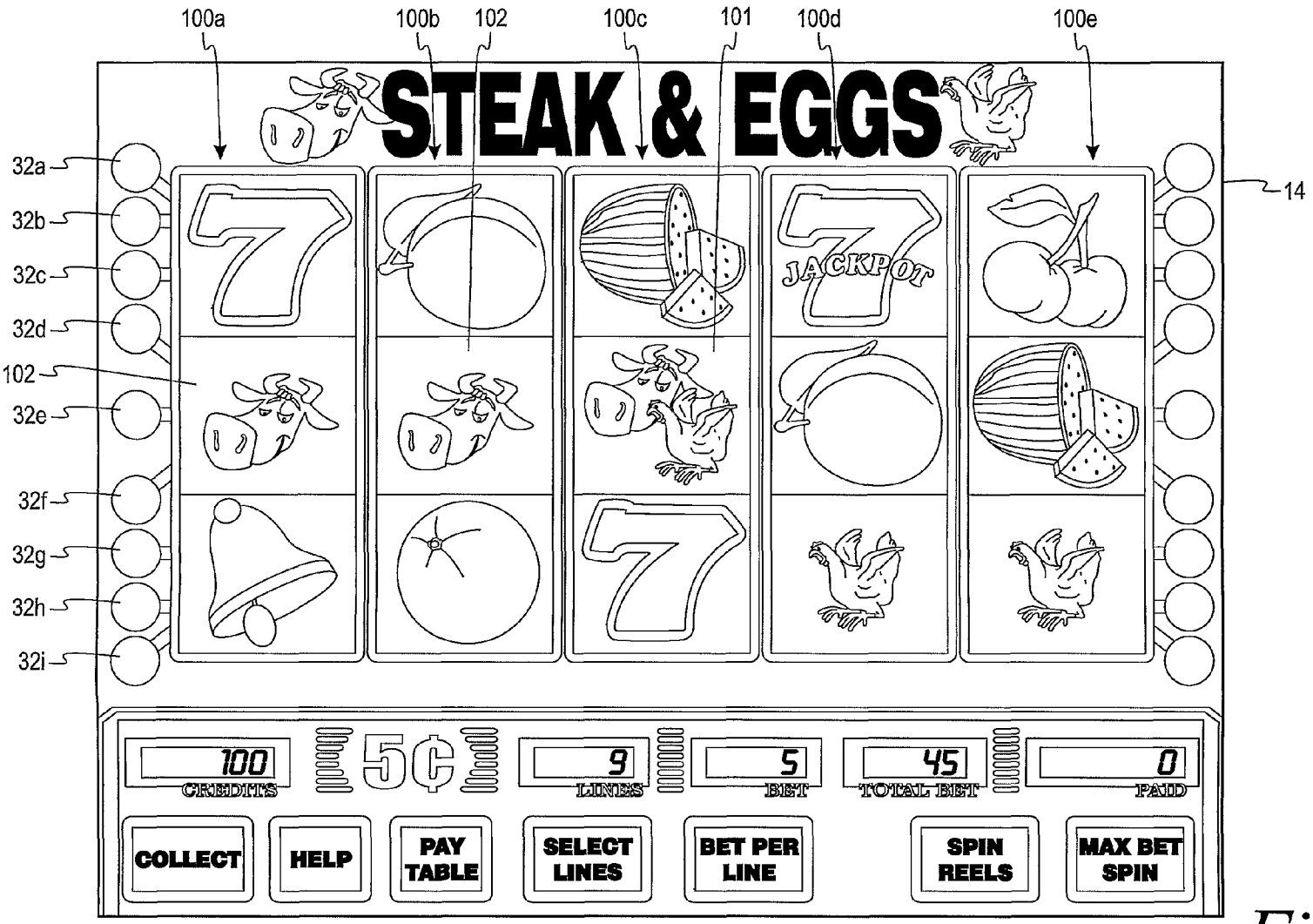
FIG. 3 is a first screen shot showing one example of a display screen showing aspects of at least some of the present concepts.
Figure 4:
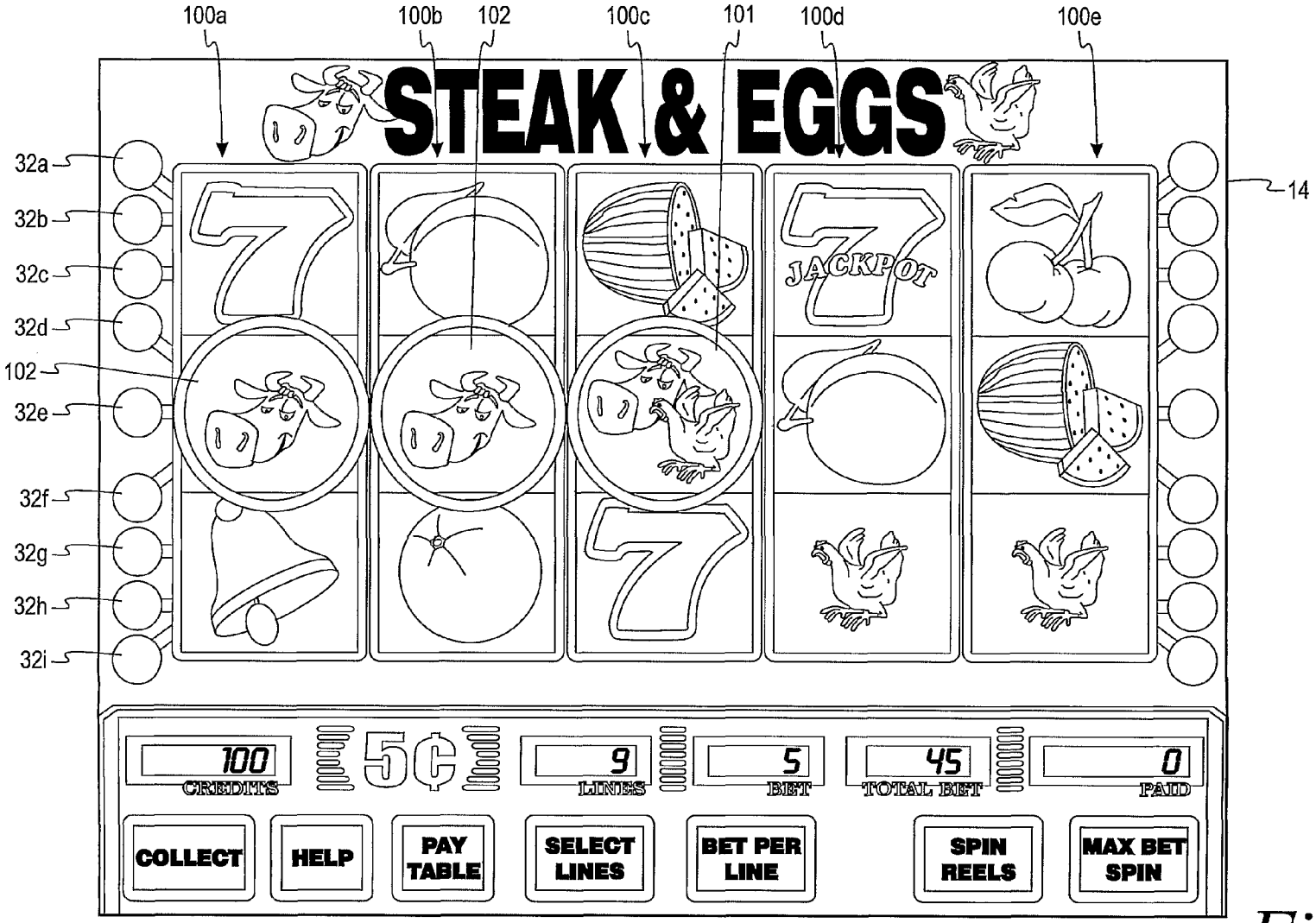
FIG. 4 is a second screen shot showing another example of a display screen showing aspects of at least some of the present concepts.

The gaming machine 10 is used for basic wagering games comprising a multi-line slot game generally include a plurality of simulated spinning reels 100*a*, 100*b*, 100*c*, 100*d*, and 100*e*, such as shown in the example of FIG. 3. For each play in the purchased series of plays in the block, the reels 100*a-e* are spun and stopped to place symbols on the reels in visual association with a number of possible pay lines 32*a*, 32*b*, 32*c*, 32*d*, 32*e*, 32*f*, 32*g*, 32*h*, and 32*i*. Each of the pay lines 32*a-i* extends through one symbol on each of the reels 100*a-e*. The number of reels 100 and the number of possible pay lines 32 may, of course, be varied to be more or less than the number shown in FIG. 3.

In accordance with the present concepts, the gaming machine 10 initially receives a wager from a player to purchase one or a series of plays of the wagering game. The basic game may include, for example, slots, poker, keno, bingo, blackjack, and roulette, but is not limited thereto and may include any type of wagering game. The series of plays of the wagering game, referred to herein as a "block" of wagering games or block wagering game, may comprise two or more wagering games played serially. In some preferred aspects, the block of wagering games may comprise 5, 10, 20, 25, 50, or even 100 or more wagering games. In a preferred aspect, the gaming machine 10 would provide the player the option of selecting from one of a desired plurality of options of blocks of wagering games. For example, the player may be permitted to purchase a block of 5, 10, 20, 25, or 50 wagering games to be played serially. In other aspects of the present concepts, the player is not permitted to select the number of plays in a wagering game series (e.g., there is only one option or the controller 34 selects the number of plays).

Accordingly, since the player is purchasing a block of wagering games, the wager will correlate to a multiple of the wager selected for each individual wagering game in the block of wagering games. In at least some embodiments, a discount may optionally be provided to a player purchasing a block of wagering games. For example, a purchase of 25 games at a selected per game wager (e.g., 40 credits per game (4 credits per pay line)) may optionally provide the player with an extra credit per pay line (i.e., 5 credits total), or some other benefit. A discount may also optionally increase for increasing numbers of wagering games in the purchased block such that the benefit would be higher for a block of 100 games than it would be for a block of 10 or 25 games.

If the gaming machine 10 comprises a multi-line slot game, such as shown in FIG. 3, the player may select his or her wager for the series of plays of the game in a number of ways depending upon the input configuration. In general, the player is able to select the number of games to be played in a block (e.g., 50 games) and designate a wager per game or simply a total wager. The selected number of wagered credits may vary in "n" credit intervals between a minimum number and a maximum number for a given block size.

In the following example, a player is purchasing a block of ten wagering games and the gaming machine 10 has nine pay lines with a maximum bet per pay line 32*a-i* of five credits. A minimum wager could be a single credit on a single pay line, which would yield a minimum wager of 10 credits for the series of wagering games to be played in the block wagering game. It may be desirable to impose an arbitrarily higher minimum wager such as, but not limited to a minimum of one credit for each payline (e.g., 9 credits/game) for a total minimum wager of 90 credits for a ten game block. In another aspect, a player be required to place a maximum bet along at least one pay line (e.g., 5 credits/game) for a minimum wager of 50 credits for a ten game block. In still another aspect, a player may be permitted to, or may be required to, place a maximum bet of five credits per each of the nine paylines for each game in the block wagering game for a total of 450 credits for a ten game block. In some embodiments, minimum wagers may be increased to correspond to optional benefits arising from the purchase of a block of wagering games, which would not otherwise be present if the games were played separately. Such optional benefits might include, but are not limited to, different or higher value awards and/or bonus games.

In at least some embodiments, a player may be provided the option of tailoring the wagering for different portions of the block of wagering games. For example, a player may elect to wager the "Max Bet Spin" to place a maximum bet (e.g., 5 credits) along all pay lines (e.g., 9 pay lines) for each of the first 25 games in a 50 game block, but may elect to only wager an amount corresponding to three credits per pay line for nine pay lines for the remainder of the block wagering games.

In response to the player's wager and other inputs, as optionally required by the controller 34, the gaming machine 10 provides the player with the series of plays of the block purchased by the player. In accord with at least some embodiments of the present concepts, the gaming machine 10 conducts a basic wagering game for each play in the block wagering game, but does not conduct any bonus games triggered by respective special outcomes in the basic wagering game until after the play of every basic wagering game in the block has been completed. In these embodiments, the player's enjoyment of the basic wagering game is not interrupted and the player is permitted to play any bonus games, as a separate set of games, following completion of the block of basic wagering games.

In conventional fashion, the basic wagering game comprises the generation by the controller 34 of at least one random event. If the random event(s) correspond to predetermined random events associated with an award or benefit, such as would be typically denoted in a pay table, an award is provided to the player. The random event in the basic wagering game for each play is preferably, but not necessarily independent of other plays of the basic wagering game in the block wagering game. Included among the basic wagering game outcomes are special outcomes inclusive of bonus triggering outcomes to trigger one bonus game or a selected one of a plurality of bonus games. A special outcome may be defined in any number of ways. For example, a special outcome may occur when a special symbol or a special combination of symbols appears on one or more of the reels 100*a-e*. The special outcome may require the special symbol or symbol combination to appear along an active pay line, or may alternatively require the special symbol or symbol combination to appear anywhere on the display 14 regardless of whether the symbols are along an active pay line.

In accord with at least some aspects of the present concepts, the appearance of a special outcome does not cause the machine to shift operation from the basic game to the bonus game associated with that special outcome, but rather defers play of the bonus game(s) until after all of the basic wagering games in the block of wagering games have been played. Although not a preferred aspect of the present concepts, the present concepts include deferring play of some (i.e., one or more) bonus game(s) until after all of the basic wagering games in the block of wagering games have been played, while permitting play of some bonus game(s) prior to completion of all of the basic wagering games in the block of wagering games. In other words, some, but not all, bonus games may be deferred to mitigate, minimize, and/or eliminate interruptions in the block of wagering games. For example, a plurality of bonus games may be achievable for various bonus triggering events occurring in association with the basic wagering games. Lower levels of the bonus game may be deferred until after completion of the block wagering game, but a high level bonus game may be permitted to be played immediately subsequent to the originating basic wagering game.

The present concepts include any mechanism or device by which one or more bonus games enabled by the occurrence of a bonus triggering event in a basic wagering game in a block wagering game are accrued or banked for play at a later time. For example, in at least one embodiment, the controller 34 may comprise a counter (e.g., software, hardware, and/or firmware) configured to count a number of bonus game triggering events associated with outcomes of each of the basic wagering games in the block wagering game. Although each bonus game triggering event would be registered, the controller 34 would not permit the bonus game(s) to be played subsequent or substantially concurrent to the basic wagering game within which the bonus game triggering event occurred, as would be the case with conventional bonus games. Instead, the controller 34 would initiate play of the bonus game(s), corresponding in number to the counted number of bonus game triggering events, only following completion of the block wagering game. Alternatively, the bonus game(s) could be deferred by the controller 34 until such time as the player's gaming session has ended, such as by a zeroing of the credit meter or following passing of a predetermined amount of time (e.g., 5 seconds), with an optional countdown or display of options, following the zeroing of the credit meter.

In accord with the present concepts, a player may even be provided an option of disabling the aforementioned bonus banking or deferral feature and playing the bonus(es) at the time that the bonus is enabled (e.g., following the base wagering game associated with the bonus triggering event).

In accord with other aspects of the present concepts, a player may be provided an option of banking the accrued bonus game(s) for play at any time subsequent to completion of the block wagering game. In one embodiment, the accrued bonus game(s) may be stored in a storage device 36, subject to recall or play by the player at a subsequent point in the gaming session. The player may simply elect to play the accrued bonus game(s) by an appropriate input to a player input device (e.g., 24, 26) or a player may provide inputs to play the accrued bonus game(s) at the end of a gaming session, which might occur after the end of the block wagering game, or even in a completely different gaming session on the same day or at a later date. The player's accrued bonus game(s) may be stored, therefore, on a memory device, such as memory 36 (e.g., in association with a player ID number or other tracking number or positive means of identification), a portable data storage device (e.g., a substrate bearing a magnetic strip), a redeemable ticket or card which may be read by an information reader 52 of the gaming machine 10, or even a security-paper based voucher redeemable in person at a casino cashier for a corresponding token, ticket, card, or data entry suitable to reinstate the accrued bonus game(s) to a player's gaming machine. The player may accordingly access, or have accessed, the record or data corresponding to the accrued bonus game(s) at any desired time.

The present concepts regarding deferral of game play are not limited to the above example wherein bonus games triggered or enabled by play of a block game are deferred. Instead, the deferral of bonus games in accord with the present concepts extends to the deferral of any bonus game arising from any base wagering game. For example, the present concepts encompass the deferral of a single bonus game arising from a player's single play of a base wagering game. In another example consistent with at least some aspects of the present concepts, a player may play successive rounds of a wagering game on a gaming machine 10 without ever purchasing a block of games (e.g., successive play of 14 or 37 rounds of a basic wagering game). At some point during the successive plays of the wagering game, when the player qualifies for a bonus game, he or she may defer the bonus game for later play. This deferral may be in a manner consistent with the above discussion including, but not limited to, storage of the pertinent information in a storage device 36.

In other aspects of game play in accord with the present concepts, simultaneous bonuses may be triggered at the same time, as shown in FIGS. 3-12, which presents representations of such concepts in the context of a "Steak and Eggs" game theme. In FIG. 3, showing the outcome of a basic game, the reels 100*a-b* each display a bull or cow (hereinafter "cow") 102 in the center position and the reel 100*c* is displaying a dual symbol 101 containing both a cow and a chicken in the center position. At the bottom of the screen, the player is shown to have 100 credits, of which nine paylines 32*a-i* had been selected for wagering and five credits were wagered on each of the nine paylines (i.e., 45 credits total wager). In the illustrated embodiment, the presence of the cow 102 in each of reels 100*a*-100*c*, such as highlighted by the circles symbols in FIG. 4, satisfies one basic wagering game winning outcome and also comprises a "Steak" bonus round triggering outcome.

Figure 5:
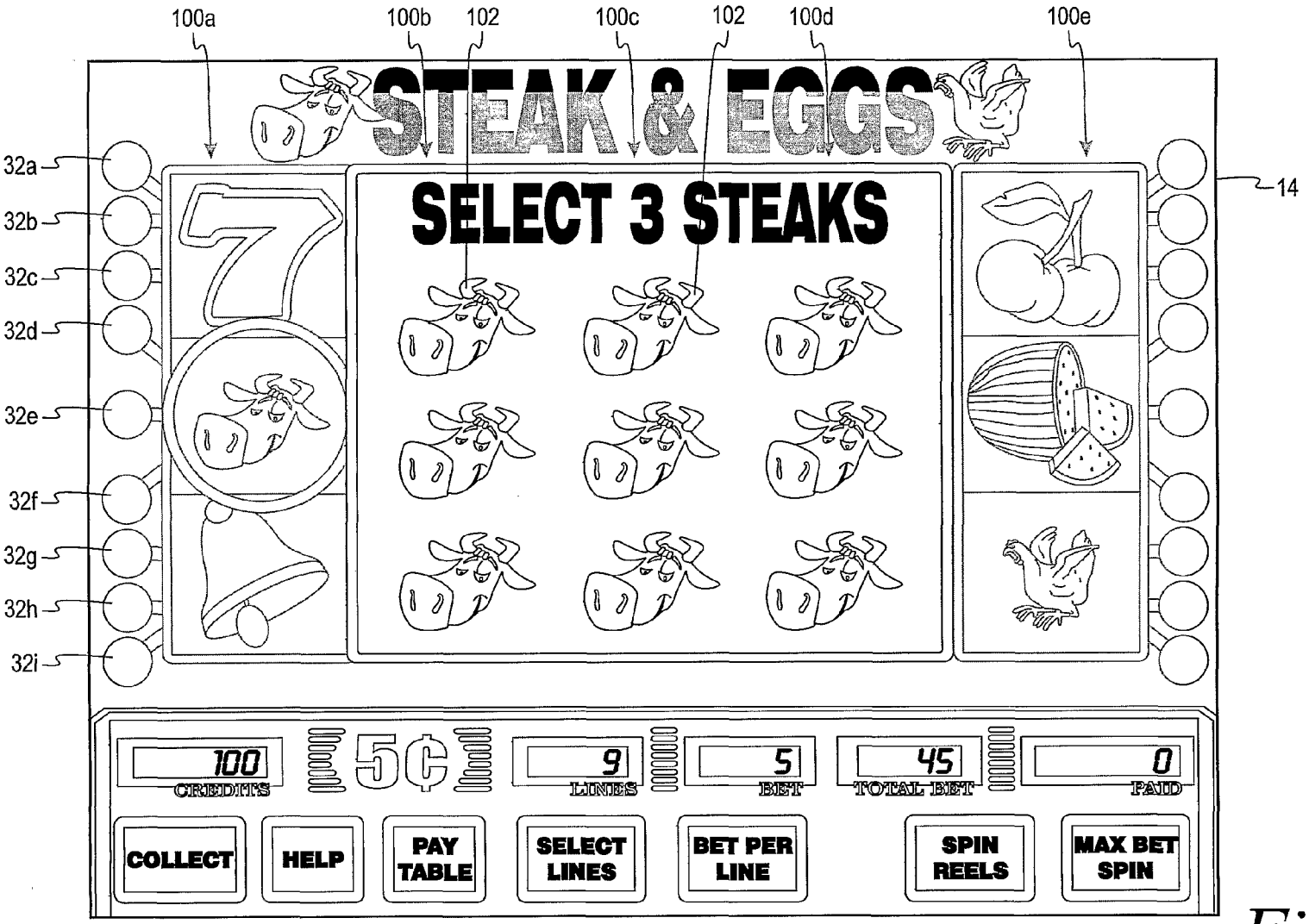
FIG. 5 is a third screen shot showing another example of a display screen showing aspects of at least some of the present concepts.
Figure 6:
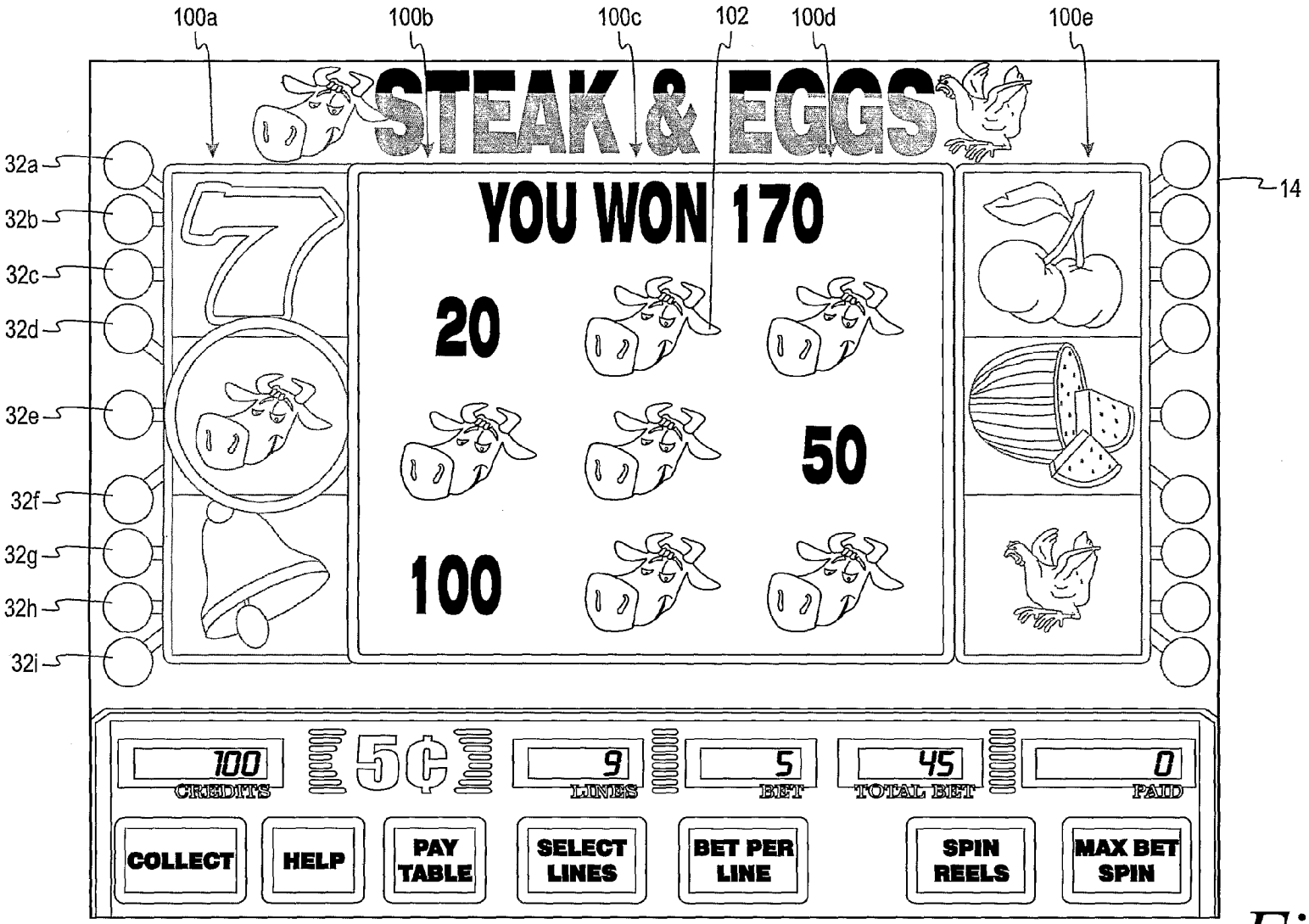
FIG. 6 is a fourth screen shot showing another example of a display screen showing aspects of at least some of the present concepts.

FIG. 5 shows a "Steak" bonus round wherein an array of cow symbols 102, here a 3×3 array, is presented to the player. In various embodiments, the player may be presented with a predetermined number of selections or may be permitted to continue choosing symbols and accruing awards until a bonus terminating outcome is selected. In the present example, as shown in FIG. 6, the player is permitted three selections, each selection revealing a credit award. Once all of the selections have been made, the combined total of all of the awards is displayed (e.g., 170 credits, as shown).

Figure 7:
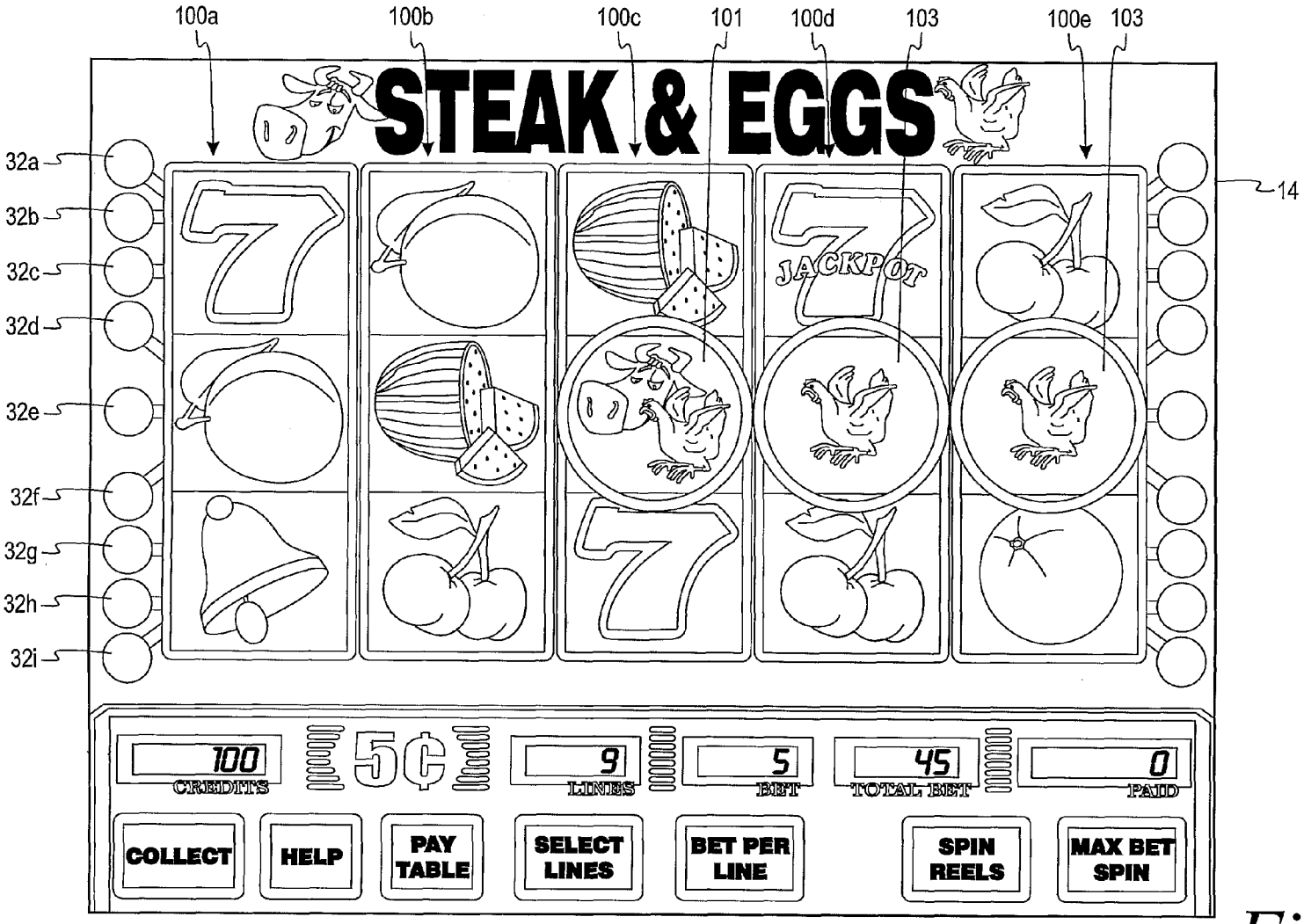
FIG. 7 is a fifth screen shot showing another example of a display screen showing aspects of at least some of the present concepts.

FIG. 7 shows the outcome of another basic game in accord with the present concepts. In this example, the reel 100*c* is displaying a dual symbol 101 containing both a cow and a chicken in the center position and each of the reels 100*d-e* displays a symbol 103 of a chicken in the center position. At the bottom of the screen, the player is again shown to have 100 credits, of which nine paylines 32*a-i* had been selected for wagering and five credits were wagered on each of the nine paylines (i.e., 45 credits total wager). The presence of the chicken symbol 103 in each of reels 100*c*-100*e*, such as highlighted by the circles symbols in FIG. 7, satisfies one basic wagering game winning outcome and also comprises an "Eggs" bonus round triggering outcome.

Figure 8:
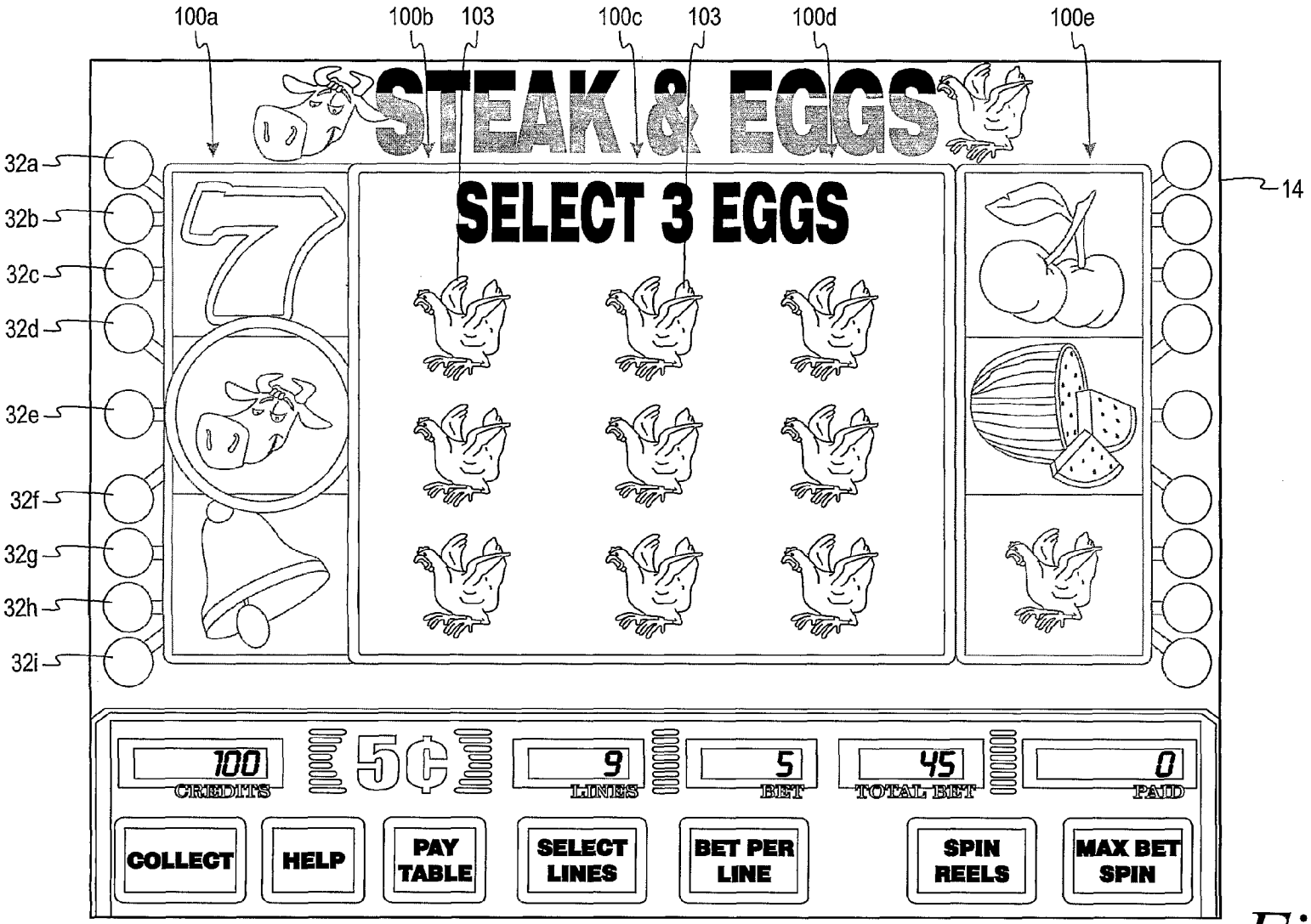
FIG. 8 is a sixth screen shot showing another example of a display screen showing aspects of at least some of the present concepts.
Figure 9:
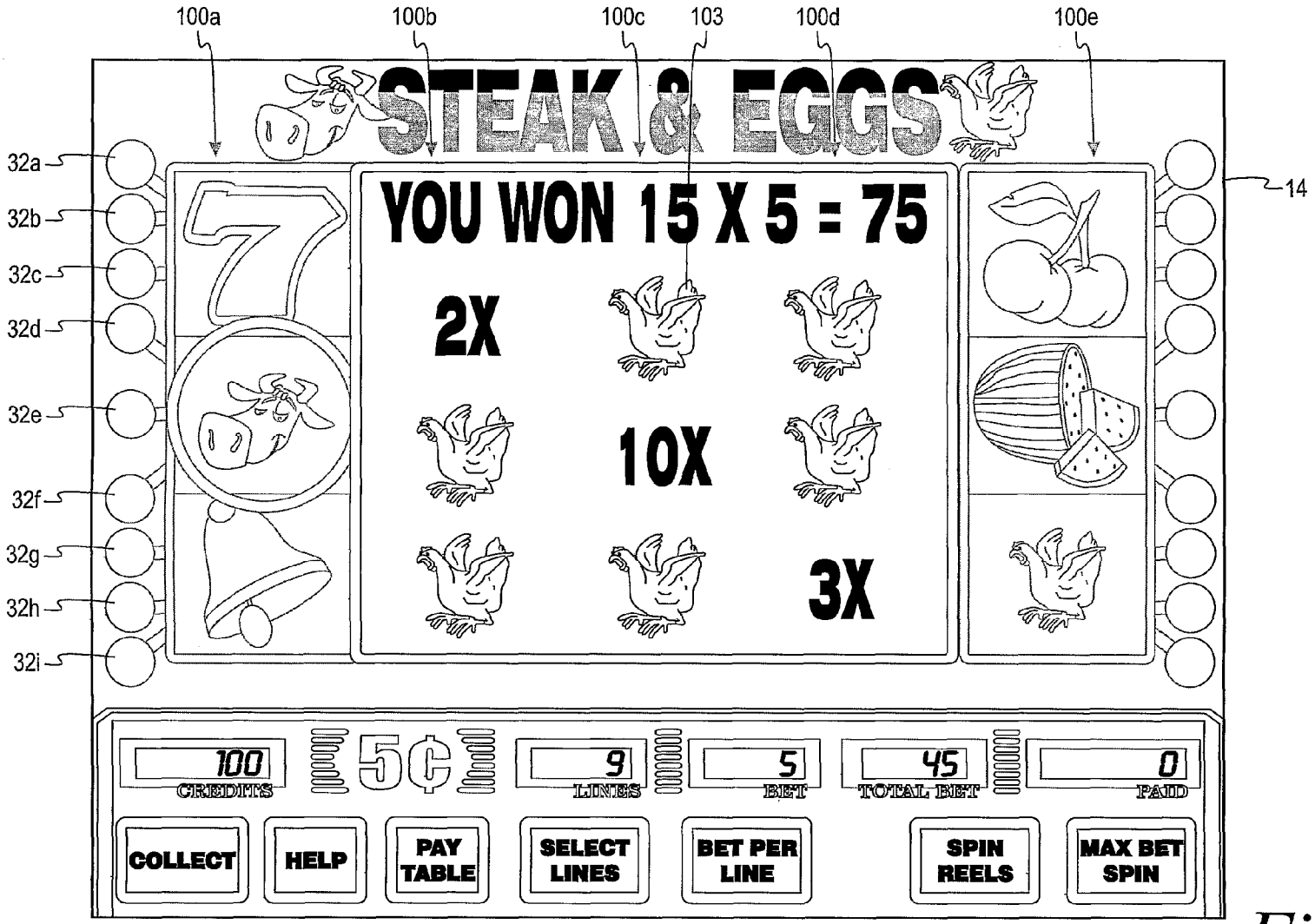
FIG. 9 is a seventh screen shot showing another example of a display screen showing aspects of at least some of the present concepts.

FIG. 8 shows an "Eggs" bonus round wherein an array of chicken symbols 103, here a 3×3 array, are presented to the player. As noted above, the player may be presented with a predetermined number of selections or may be permitted to continue choosing symbols and accruing awards until a bonus terminating outcome is selected. In the present example, as shown in FIG. 8, the player is permitted three selections. As shown in FIG. 9, each selection of a chicken symbol 103 in the screen of FIG. 8 reveals a multiplier award. Once all of the selections have been made, the combined total of all of the multipliers is added together and multiplied by the credits wagered on the pay line which triggered the bonus game, for a total of 75 credits.

Figure 10:
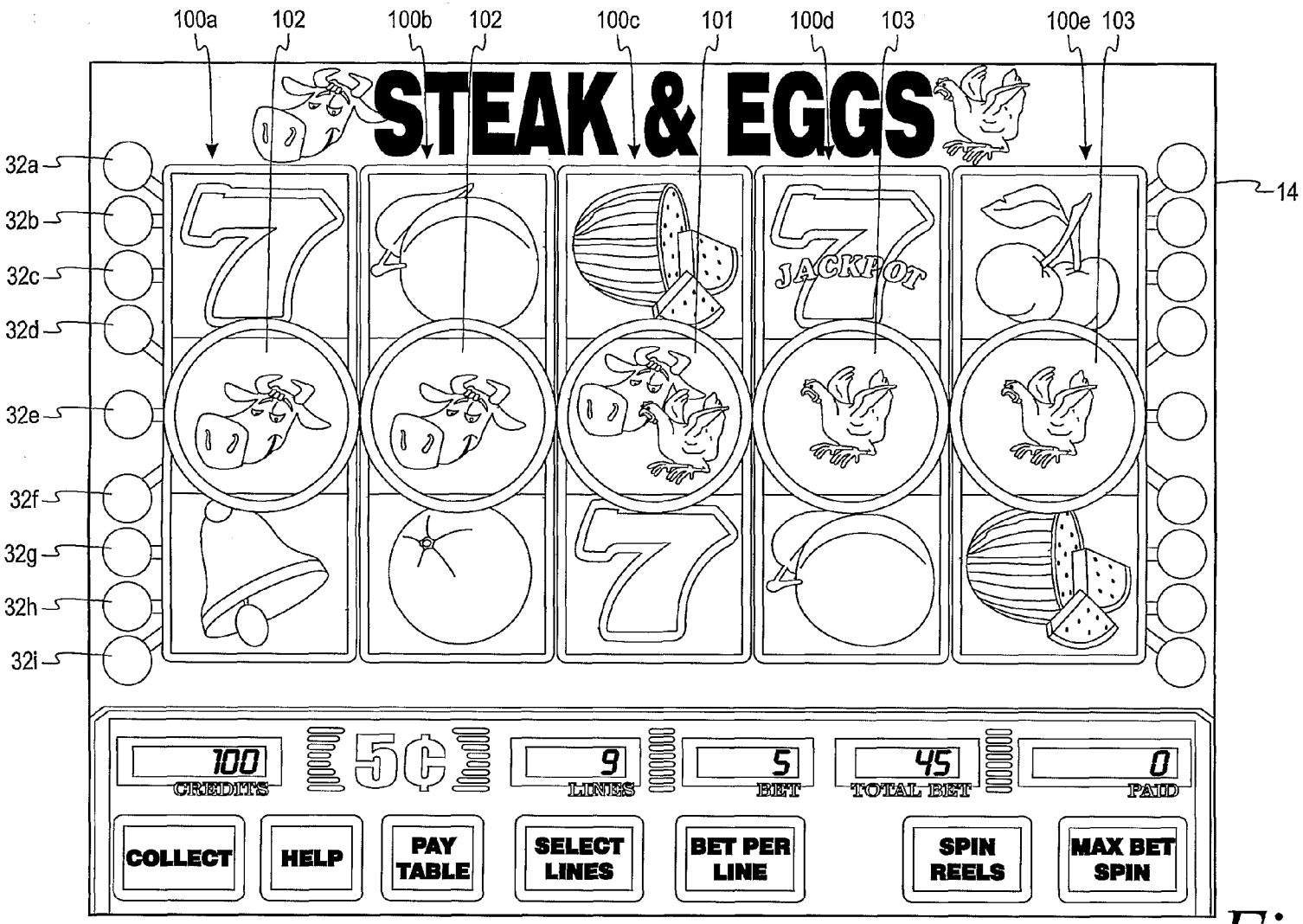
FIG. 10 is an eighth screen shot showing another example of a display screen showing aspects of at least some of the present concepts.

FIG. 10 shows yet another outcome of a basic game in accord with the present concepts. At the bottom of the screen, the player is shown to have 100 credits, of which nine paylines 32*a-i* had been selected for wagering and five credits were wagered on each of the nine paylines (i.e., 45 credits total wager). In this example, reels 100*a-b* each display a cow symbol 102 in the center position and the reel 100*c* is displaying a dual symbol 101 containing both a cow and a chicken in the center position. The reels 100*d-e* each display a chicken symbol 103 in the center position. The presence of the cow symbol 102 in each of the reels 100*a*-100*c*, such as highlighted by the circles in FIG. 10, satisfies one basic wagering game winning outcome and also comprises a "Steak" bonus round triggering outcome. Likewise, the presence of the chicken symbol 103 in each of the reels 100*c*-100*e*, such as highlighted by the circles in FIG. 10, satisfies another basic wagering game winning outcome and also comprises an "Eggs" bonus round triggering outcome. Therefore, both the "Steak" and the "Eggs" bonus rounds are triggered together in a "Steak 'N' Eggs Bonus." The "Steak 'N' Eggs Bonus" comprises the simultaneous play of the "Steak" bonus and the "Eggs" bonus.

Figure 11:
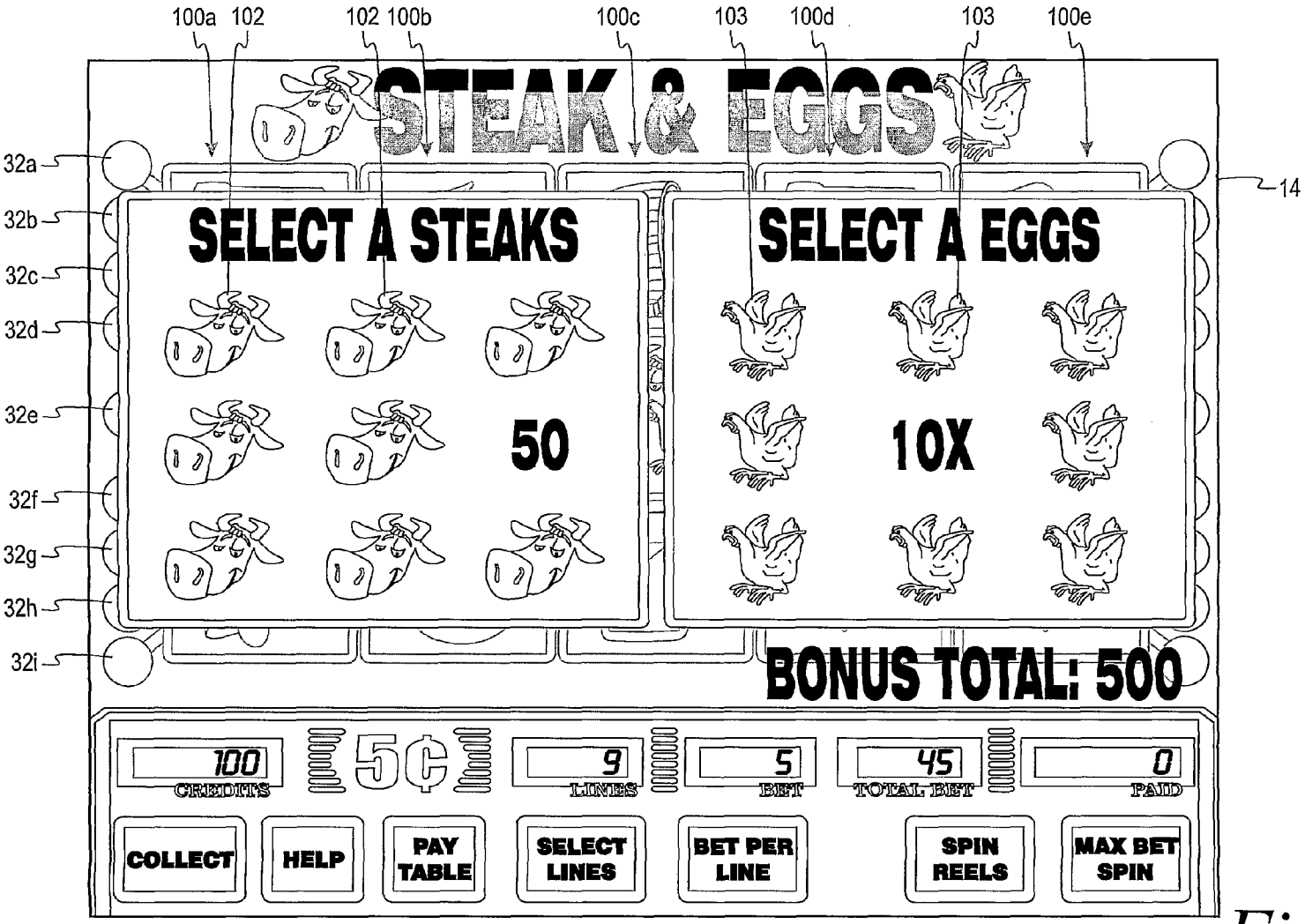
FIG. 11 is an ninth screen shot showing another example of a display screen showing aspects of at least some of the present concepts.

FIG. 11 shows the simultaneous play of both a "Steak" bonus round wherein an array of cow symbols 102, here a 3×3 array, are presented to the player and an "Eggs" bonus round wherein an array of chicken symbols 103, here a 3×3 array, are presented to the player. Thus, the player is permitted to play both bonuses at the same time with a selection from each bonus being combined into an overall bonus award. For example, FIG. 11 shows a point at which a player has performed a first selection in the "Steak" array to reveal an award of 50 credits and has performed a first selection in the "Eggs" array to reveal a multiplier of 10×. In this instance, the player will receive an award of 500 credits. In accord with the previous examples, the player may be permitted to select a total of three cow symbols 102 from the "Steak" bonus round and a total of three chicken symbols 103 from the "Eggs" bonus round to yield a large credit in the "Steak" bonus round which is multiplied by a large multiplier in the "Eggs" bonus round". However, the above examples are not limited to any predetermined number of picks and the game may be configured in accord with the above concepts to support any number of picks possible in an n×n or n×n array, where n and m may be any integer. The number of picks between one bonus round (e.g., a "Steak" bonus round) and another bonus round (e.g., an "Eggs" bonus round) may also be varied.

In accord with the above disclosure, players may also be provided an option of deferring play or banking any of the above bonus games (e.g., "Eggs," "Steak," and/or "Steak 'N' Eggs") to play at a later time.

In still additional embodiments, the first and second bonus rounds may be merged into a single combined matrix wherein a player may still be permitted to select a predetermined number of each of the symbols (e.g., 102, 103) associated with respective ones of the first and second bonus rounds.

In accord with the above examples shown in FIGS. 3-11, one example of a dual-symbol reel symbol 101 is illustrated in the reel 100*c*. It is not necessary that the function represented in the preceding example be denoted by a dual-symbol reel symbol 101. Instead, the same function may be associated with an arbitrary reel symbol (e.g., a wildcard). Further, such function may be combined with the above-noted function of deferring one or more bonuses for subsequent game play.

Thus, the dual-symbol reel symbol 101, or equivalent thereof, may complete winning combinations for other reels. It is noted, however, that the dual-symbol reel symbol 101 is not itself a required element of the present concepts and the present concepts include any method, system, device and/or function for triggering two or more bonus games simultaneously and concurrently playing those bonus games. For example, a six-reel game could trigger two bonuses simultaneously if the left three reels produced a cow symbol 102 and the right three reels produced a chicken symbol 103. Alternatively, in a five-reel game, satisfaction of a first bonus game condition (e.g., a cow symbol 102 shown in each of the left three reels) may cause the controller to process the remaining reels to determine in a second bonus game condition (e.g., two chicken symbols 103) has been satisfied. In this case, the controller 34 may then activate both of the bonus games simultaneously.

Although the bonus games simultaneously enabled and played above are dissimilar in at least one respect (e.g., award values vs. multipliers), as is presently preferred, the themes of the bonuses may alternatively be similar. For example, a player may pick award values in each bonus game.

In accord with some aspects of the present concepts, the basic wagering game features and bonus features noted with respect to the "Steak 'N' Eggs" game, above, may be combined with the concepts disclosed above relating to the play of block wagering games and deferral of play of some of or all of the bonus game(s). Thus, the basic wagering game may be configured to trigger not only one bonus game per play of the basic wagering game, but may be configured to trigger multiple bonus games provided certain game conditions are met. Such bonus games would then be deferred in accord with the player's desires and/or the gaming machine's 10 settings.

Another of the present concepts includes a bonus upgrade feature, which may be used in isolation or in combination with either of the aforementioned features. The bonus upgrade feature permits a player who has accrued two or more bonuses to "trade them in" to upgrade to a better bonus. With regard to the first of the aforementioned features, a play having a plurality of banked bonuses (e.g., 10 bonuses) could trade them in for an improved bonus (e.g., one super bonus). This option may be attractive as it would lessen the time required to play numerous bonus rounds, resulting in an increased "coin-in" to the gaming machine 10 and it could optionally provide larger awards than might otherwise be possible playing the combination of the banked bonuses. With respect to the second of the aforementioned features, the player may be given the opportunity to play an improved bonus rather than plural simultaneous bonuses. In either case, the improved bonus may have the same structure as the underlying foregone bonuses but have better potential or actual payouts and/or outcomes. Alternatively, the improved bonus may be a totally different bonus altogether, thereby providing players with a new experience.

In accord with the above disclosure, players may also be provided an option of trading in any of the above bonus games (e.g., "Eggs," "Steak," and/or "Steak 'N' Eggs") for a better bonus (e.g., trading in 3 "Eggs" bonuses for one "Steak 'N' Eggs" bonus).

In relation thereto, the player may be taken out of or opt out of the decision loop and the controller 34 configured to automatically optimize the player's potential outcome, trading the player's accrued bonuses or simultaneously triggered bonuses whenever the improved result is statistically advantageous to the player. For gaming machines 10 providing player's with this opt out option, player's may further be permitted to enter user conditions or settings specifying conditions under which the player would like the controller to make such optimization decisions. A player may, for example, feel comfortable permitting the controller 34 to optimize some decisions, but not others, depending on the player's preferences for certain bonus games.

Each of these aspects and embodiments, combinations thereof, and obvious variations thereof are contemplated as falling within the spirit and scope of the claimed invention, which is set forth in the following claims. For example, although at least some of the examples above illustrated aspects of game play wherein two bonus games were simultaneously enabled and/or played, the present concepts are not limited to concurrent play of two bonus games and may, in fact, include concurrent play of more than two bonus games. Still further, although the present examples generate illustrate embodiments utilizing reels 32*a-i* wherein the symbols 101, 102, 103 associated with the bonus triggering outcomes are displayed adjacent one another, the present concepts also include scattered arrangements of symbols and even the occurrence or display of the dual symbol 101 multiple-bonus trigger outcome, whether embodied within a specific symbol or not, on a portion of a display other than along a payline.

The appended claims reflect certain aspects and combinations of the present concepts, but are not exhaustive of all such aspects and combinations. For example, the present concepts include all possible logical combinations of the claims and of the various claim elements appended hereto, without limitation, within the associated claim sets regardless of the presently indicated dependency.

What is claimed is:

1. A method of conducting a wagering game on a gaming system, the gaming system including an electronic gaming machine and one or more controllers, the electronic gaming machine including one or more electronic input devices and one or more electronic display devices coupled to a cabinet, the method comprising:

detecting, via at least one of the one or more electronic input devices, a physical item associated with a monetary value, the monetary value establishing a credit balance that changes based on play of the wagering game;

receiving, via at least one of the one or more electronic input devices, an initiating input from a player to play the wagering game;

randomly determining, via at least one of the one or more controllers, a single base game outcome for a single play of a base game of the wagering game, the randomly determined base game outcome for the single play of the base game being selected from a plurality of base game outcomes;

displaying, via at least one of the one or more electronic display devices, a plurality of game elements bearing symbols representing the randomly determined base game outcome of the single play of the base game, at least one of the game elements displaying a symbol representing a multiple-bonus trigger outcome;

simultaneously displaying, via at least one of the one or more electronic display devices, a first bonus game triggering outcome and a second bonus game triggering outcome in the single base game outcome of the single play of the base game;

initiating a first bonus game responsive to the first bonus game triggering outcome and a second bonus game responsive to the second bonus game triggering outcome;

randomly determining, via at least one of the one or more controllers and independent of the base game outcome, a first bonus game outcome of the first bonus game and a second bonus game outcome of the second bonus game;

concurrently displaying, via at least one of the one or more electronic display devices, the first and second bonus games and their respective bonus game outcomes, wherein the concurrently displaying the first and second bonus games and their respective bonus game outcomes is deferred until after the first and second bonus game triggering outcomes are simultaneously displayed via the display device in the single base game outcome;

discontinuing displaying, via the one or more electronic display devices, the first and second bonus games and their respective bonus game outcomes during an immediate subsequent play of the base game; and receiving, via at least one of the one or more electronic input devices, a cashout input from the player to initiate a payout from the credit balance.

2. A method of conducting a wagering game according to claim 1, wherein said simultaneously displaying further comprises:

providing, as at least one of said plurality of potential randomly determined outcomes, a multiple-bonus trigger outcome triggering of the first bonus game in combination with at least a first predetermined combination of randomly determined outcomes in the remaining plurality of game elements, enabling triggering of the second bonus game in combination with at least a second predetermined combination of randomly determined outcomes in the remaining plurality of game elements, and enabling triggering of multiple bonus games in combination with at least a third predetermined combination of randomly determined outcomes in the remaining plurality of game elements.

3. A method of conducting a wagering game according to claim 1, further comprising:

triggering multiple bonus games for simultaneous play in response to the displayed multiple-bonus trigger outcome.

4. A method of conducting a wagering game according to claim 1, wherein the first bonus game outcome affects at least one aspect of the second bonus game outcome.

5. A method of conducting a wagering game according to claim 1, further comprising:

enabling multiple bonus games in response to the display of said multiple-bonus trigger outcome along a payline.

6. A method of conducting a wagering game according to claim 5, further comprising:

deferring the enabled multiple bonus games;

receiving an input from a player to trade a plurality of the deferred enabled bonus games for an improved bonus game; and trading the plurality of deferred enabled bonus games for the improved bonus game.

7. A method of conducting a wagering game according to claim 5, further comprising:

storing information relating to the enabled multiple bonus games via a data storage medium to permit subsequent play of the multiple enabled bonus games.

8. A method of conducting a wagering game according to claim 5, further comprising:

receiving an input from a player to save and defer the multiple bonus games; and saving and deferring the enabled multiple bonus games.

9. A method of conducting a wagering game according to claim 1, wherein the wagering game is a reel-based game, and wherein the game elements comprise reels.

10. A method of conducting a wagering game on a gaming system, the gaming system including an electronic gaming machine and one or more controllers, the electronic gaming machine including one or more electronic input devices and one or more electronic display devices coupled to a cabinet, the method comprising:

detecting, via at least one of the one or more electronic input devices, a physical item associated with a monetary value, the monetary value establishing a credit balance that changes based on play of the wagering game;

receiving, via at least one of the one or more electronic input devices, an initiating input from a player to play the wagering game;

randomly determining, via at least one of the one or more controllers, a single base game outcome for a single play of a base game of the wagering game, the randomly determined base game outcome for the single play of the base game being selected from a plurality of base game outcomes;

displaying, via at least one of the one or more electronic display devices, a plurality of game elements bearing symbols representing the randomly determined base game outcome of the single play of the base game;

simultaneously displaying, via at least one of the one or more electronic display devices, a first bonus game triggering outcome and a second bonus game triggering outcome in the single base game outcome of the single play of the base game, the plurality of game elements:

displaying on at least one of the game elements a symbol representing a multiple-bonus trigger outcome along a payline, and displaying along said payline two symbols representing said first bonus game triggering outcome;

initiating a first bonus game responsive to the first bonus game triggering outcome and a second bonus game responsive to the second bonus game triggering outcome;

randomly determining, via at least one of the one or more controllers and independent of the base game outcome, a first bonus game outcome of the first bonus game and a second bonus game outcome of the second bonus game;

concurrently displaying, via at least one of the one or more electronic display devices, the first and second bonus games and their respective bonus game outcomes, wherein the concurrently displaying the first and second bonus games and their respective bonus game outcomes is deferred until after the first and second bonus game triggering outcomes are simultaneously displayed via the display device in the single base game outcome;

discontinuing displaying, via the one or more electronic display devices, the first and second bonus games and their respective bonus game outcomes during an immediate subsequent play of the base game; and receiving, via at least one of the one or more electronic input devices, a cashout input from the player to initiate a payout from the credit balance.

11. A computer-implemented method of conducting a wagering game on a gaming system, the gaming system including an electronic gaming machine and one or more controllers, the electronic gaming machine including a cabinet with one or more electronic input devices and one or more electronic display devices coupled to the cabinet, the method comprising:

detecting, via at least one of the one or more electronic input devices, a physical item associated with a monetary value, the monetary value establishing a credit balance that changes based on play of the wagering game;

receiving, via at least one of the one or more electronic input devices, a wager input from a player to play the wagering game;

randomly determining, via at least one of the one or more controllers, a basic game outcome for a single play of a basic game of the wagering game, the randomly determined basic game outcome being selected from a plurality of basic game outcomes;

displaying, via at least one of the one or more electronic display devices, the randomly determined basic game outcome for the single play of the basic game of the wagering game;

in response to the basic game outcome including a first bonus game trigger but not a second bonus game trigger, displaying a first bonus game via at least one of the one or more electronic display devices;

in response to the basic game outcome including the second bonus game trigger but not the first bonus game trigger, displaying a second bonus game via at least one of the one or more electronic display devices;

in response to the displayed basic game outcome for the single play of the basic game simultaneously including both the first bonus game trigger and the second bonus game trigger, randomly determining, via at least one of the one or more controllers and independent of the basic game outcome, a first bonus game outcome of the first bonus game and a second bonus game outcome of the second bonus game, and concurrently displaying the first and second bonus games and their respective bonus game outcomes via at least one of the one or more electronic display devices such that a time period for playing the first and second bonus games overlaps, wherein the concurrently displaying the first and second bonus games and their respective bonus game outcomes is deferred until after the first and second bonus game triggers are simultaneously displayed via the at least one display device in the single basic game outcome, the deferring being performed in response to a player request; and discontinuing display of the first and second bonus games and their respective bonus game outcomes during an immediate subsequent play of the basic game.

12. The method of claim 11, wherein the displaying the randomly determined basic game outcome includes displaying the randomly determined basic outcome on a plurality of symbol-bearing reels that are rotated and stopped.

13. The method of claim 11, wherein the first bonus game includes a first plurality of player-selectable elements and the second bonus game includes a second plurality of player-selectable elements, and wherein in response to the basic game outcome including both the first and second bonus game triggers, allowing a player to select elements from both the first and second pluralities of elements prior to completion of the first and second bonus games.

14. The method of claim 11, wherein the concurrently displaying of the bonus games and their respective bonus game outcomes is deferred until after another play of the basic game of the wagering game.

15. The method of claim 11, further comprising:

receiving, via at least one of the one or more electronic input devices, a selection from a player to purchase a block of basic wagering games;

displaying, via at least one of the one or more electronic display devices, an outcome for each of the basic wagering games in the purchased block of basic wagering games; and enabling the first bonus game, the second bonus game, or both, for each outcome of each basic wagering game in the purchased block of basic wagering games that includes the first bonus game trigger, the second bonus game trigger, or both;

postponing, until after completion of the purchased block of basic wagering games, play of all bonus games enabled during completion of the block of basic wagering games.

16. The method of claim 15, further comprising simultaneously displaying, via at least one of the one or more electronic display devices, the postponed bonus games after completion of the purchased block of basic wagering games.

17. The method of claim 11, further comprising completing the deferred bonus games without requiring the player to place an additional wager.

18. The method of claim 11, further comprising storing information relating to the deferred bonus games via a data storage medium to permit subsequent play of the deferred bonus games at any time after completion of the purchased block of basic wagering games.

19. A method of conducting a wagering game on a gaming system, the gaming system including an electronic gaming machine and one or more controllers, the electronic gaming machine including a cabinet with one or more electronic input devices and one or more electronic display devices coupled to the cabinet, the method comprising:

detecting, via at least one of the one or more electronic input devices, a physical item associated with a monetary value, the monetary value establishing a credit balance that changes based on play of the wagering game;

receiving, via at least one of the one or more electronic input devices, a wager input from a player to play the wagering game;

randomly determining, via at least one of the one or more controllers, a basic game outcome for a single play of a basic game of the wagering game, the randomly determined basic game outcome being selected from a plurality of basic game outcomes;

displaying, via at least one of the one or more electronic display devices, the randomly determined basic game outcome for the single play of the basic game of the wagering game;

in response to the basic game outcome including a first bonus game trigger but not a second bonus game trigger, displaying a first bonus game via at least one of the one or more electronic display devices;

in response to the basic game outcome including the second bonus game trigger but not the first bonus game trigger, displaying a second bonus game via at least one of the one or more electronic display devices;

in response to the displayed basic game outcome for the single play of the basic game simultaneously including both the first bonus game trigger and the second bonus game trigger, randomly determining, via at least one of the one or more controllers and independent of the basic game outcome, a first bonus game outcome of the first bonus game and a second bonus game outcome of the second bonus game, and concurrently displaying the first and second bonus games and their respective bonus game outcomes via at least one of the one or more electronic display devices such that a time period for playing the first and second bonus games overlaps, wherein the concurrently displaying the first and second bonus games and their respective bonus game outcomes is deferred until after the first and second bonus game triggers are simultaneously displayed via the at least one display device in the single basic game outcome;

in response to a player request, trading a plurality of the deferred bonus games for an improved bonus game with a higher potential payout that the traded plurality of deferred bonus games; and discontinuing display of the first and second bonus games and their respective bonus game outcomes during an immediate subsequent play of the basic game.

20. A method of conducting a wagering game on a gaming system, the gaming system including an electronic gaming machine and one or more controllers, the electronic gaming machine including one or more electronic input devices and one or more electronic display devices coupled to a cabinet, the method comprising:

detecting, via at least one of the one or more electronic input devices, a physical item associated with a monetary value, the monetary value establishing a credit balance that changes based on play of the wagering game;

receiving, via at least one of the one or more electronic input devices, a wager input from a player to play a single play of a basic game of the wagering game;

randomly determining, via at least one of the one or more controllers, a basic game outcome for the single play of the basic game of the wagering game, the randomly determined basic game outcome being selected from a plurality of basic game outcomes;

displaying, via at least one of the one or more electronic display devices, the randomly determined basic game outcome for the single play of the basic game of the wagering game;

in response to the basic game outcome including a first bonus game trigger but not a second bonus game trigger, displaying a first bonus game via at least one of the one or more electronic display devices;

in response to the game outcome including the second bonus game trigger but not the first bonus game trigger, displaying a second bonus game via at least one of the one or more electronic display devices;

in response to the displayed basic game outcome for the single play of the basic game simultaneously including both the first and second bonus game triggers, enabling a player-selected option to either (i) play the first and second bonus games concurrently such that a time period for playing the first and second bonus games overlaps, or (ii) trade in the first and second bonus games for a combined bonus game; and in response to receiving a selection of the player-selected option (i), initiating, concurrently displaying via at least one of the one or more electronic display devices, and completing the first and second bonus games, wherein the initiating, concurrently displaying, and completing the first and second bonus games is deferred until after the first and second bonus game triggers are simultaneously displayed in the single basic game outcome.

21. A gaming system for conducting a wagering game, the gaming system comprising:

an electronic gaming machine for playing the wagering game, the electronic gaming machine including a cabinet with one or more electronic input devices and one or more electronic display devices coupled to the cabinet, the one or more electronic display devices being configured to display aspects of the wagering game, the one or more electronic input devices including first and second input devices, the first input device being configured to detect a physical item associated with a monetary value that establishes a credit balance, and the second input device being configured to receive a cashout input that initiates a payout from the credit balance, the credit balance changing based on play of the casino wagering game;

a controller operable to:

randomly determine a basic game outcome for a single play of a basic game, the randomly determined basic game outcome being selected from a plurality of basic game outcomes;

direct at least one of the one or more electronic display devices to display the randomly determined basic game outcome for the single play of the basic game;

enable a first bonus game in response to the basic game outcome including a first bonus game trigger but not a second bonus game trigger;

enable a second bonus game in response to the basic game outcome including the second bonus game trigger but not the first bonus game trigger;

in response to the displayed basic game outcome simultaneously including both the first and second bonus game triggers with a symbol representing a multiple-bonus trigger outcome, concurrently enable the first and second bonus games such that a time period for playing the first and second bonus games overlaps;

randomly determine, independent of the basic game outcome, a first bonus game outcome of the first bonus game and a second bonus game outcome of the second bonus game;

direct at least one of the one or more electronic display devices to concurrently display the first and second bonus games and their respective bonus game outcomes, the concurrently displaying being deferred until after the first and second bonus game triggers are simultaneously displayed via the display device; and direct the one or more electronic display devices to discontinue display of the first and second bonus games and their respective bonus game outcomes during an immediate subsequent play of the basic game.

22. The gaming system of claim 21, wherein the first bonus game includes a first plurality of player-selectable elements and the second bonus game includes a second plurality of player-selectable elements, and wherein in response to the displayed basic game outcome including both the first and second bonus game triggers, allowing a player to select elements from both the first and second pluralities of elements prior to completion of the first and second bonus games.

23. The gaming system of claim 21, wherein the concurrently enabling the first and second bonus games is deferred until after another play of the basic game of the wagering game.

* * * * *